US005237781A

United States Patent [19]

Demetrius

[11] Patent Number: 5,237,781

[45] Date of Patent: Aug. 24, 1993

[54] HAND HELD DISC TYPE SURFACING MACHINE

[76] Inventor: Kris Demetrius, 2843 State St., Apt. 4, Santa Barbara, Calif. 93105

[21] Appl. No.: 855,789

[22] Filed: Mar. 23, 1992

[51] Int. Cl.[5] ..... B24B 55/06; B24B 23/02

[52] U.S. Cl. ..... 51/273; 51/170 T

[58] Field of Search ..... 51/273, 170 R, 170 T, 51/170 MT

[56] References Cited

U.S. PATENT DOCUMENTS

| | | | |
|---|---|---|---|
| 1,390,354 | 9/1921 | Fried | 51/273 |
| 1,393,892 | 10/1921 | Luden | 51/270 |
| 1,792,313 | 2/1931 | Measure et al. | 51/270 |
| 2,764,852 | 10/1956 | Emmons | 51/273 |
| 3,646,712 | 3/1972 | Quintana | 51/273 |
| 3,673,744 | 7/1972 | Oimden | 51/273 |
| 3,935,678 | 2/1976 | Marton | 51/273 |
| 4,135,334 | 1/1979 | Rudiger | 51/273 |
| 4,622,782 | 11/1986 | Roestenberg | 51/273 |

FOREIGN PATENT DOCUMENTS

| | | | |
|---|---|---|---|
| 2539762 | 3/1977 | Fed. Rep. of Germany | 51/273 |
| 0211467 | 12/1982 | Japan | 51/273 |

*Primary Examiner*—Roscoe V. Parker
*Attorney, Agent, or Firm*—Robert M. Sperry

[57] ABSTRACT

A disc sander, grinder, or combination machine, hand-held, having an umbrella-shaped hood enclosing the full perimeter of the disc and urged downward to contact the workpiece so air and debris particles may be drawn by a suction blower through an annulus surrounding the disc and discharged into a porous bag for collecting of debris.

Making the porous bag of wire mesh for strength and heat resistance, and making the grinding disc working surface a flat cone to help ensure better collection of debris particles are additional features.

16 Claims, 2 Drawing Sheets

HAND HELD DISC TYPE SURFACING MACHINE

BACKGROUND OF THE INVENTION

1. Field of the Invention

This invention is in the field of hand-held grinders or sanders used to prepare workpiece surfaces for painting or receiving other finishes or no further finish.

2. Description of Prior Art

A wide variety of equipment has been and currently is in use to give wood, concrete, or metal surfaces a uniform surface finish pleasing to the eye. Sanding or grinding surfaces flat is commonly required, either as a final finish or in preparation for painting, coating, or plating. My invention is primarily directed to improving hand-held machines using rotating circular discs, made of abrasive or coated on the lower (contact) surface with abrasive and brought by hand into contact with the workpiece surface, which in most cases is flat. The thrust of my improvements has to do with handling the dust and grit particles thrown off the perimeter of the rotating circular disc.

The state-of-the-art is that machine and device manufacturers have increasingly taken steps to capture airborne debris before an operator or bystander inhales it. Suction blowers incorporated into the machine, either on the electric drive motor shaft or on the shaft which carries the abrasive disc, are standard components. Various types of bags in which to collect the debris have been used, the usual arrangement being a cloth or paper bag on the side of the machine which has the problem that due to gravity it droops down onto the working surface as it fills. Suction ports of quite a few different designs are located in the vicinity of the disc periphery. Many of these have dead areas; only collecting part of the debris since they do not surround the disc fully and completely. Most allow the debris-laden air to leave the disc radially and then try to bend the airstream through a 90 degree angle to an upward direction toward the suction blower inlet. Since the debris particles are heavier than air, not all of them "make" the turn.

There is also an operational problem with current art in that obstructions such as inside corners on the workpiece, partially withdrawn nails and the like can contact the spinning disc causing sudden, unpredictable and unexpected forces on the machine and hence on the operator's hand. This element of danger, as well as the health/environmentally undesirable consequences of debris in the free air, are virtually eliminated by my invention.

SUMMARY OF THE INVENTION

This invention provides an umbrella-like hood, larger than the disc for which the machine was designed and at rest positioned slightly forward of the disc (its rim reaching a horizontal plane below the disc lower surface). The umbrella structure is spring loaded downward, toward the workpiece surface, by a bellows or spring located centrally around the upper part of the umbrella, so it's rim is urged into full circumferential contact with the flat workpiece surface. When surfacing is required up to a workpiece inside corner, a part of the umbrella structure rim can be slid sideways to expose the spinning disc locally. The dust bag may be made of more durable wire mesh, and always is supported by a bag support member (bottle-shaped) which encloses the dust bag and prevents it's drooping down onto the workpiece. For work near corners, the bag support member is made of yielding material so it can bend, as distinct from flexible material which would defeat its purpose. The invention when used on a grinder as distinct from a sander, has a rigid abrasive disc with its working surface a slight cone rather than flat. Thus the unused sector of the disc where the debris in thrown off imparts a slight upward direction to the velocity of the debris making its capture surer. In addition to ensuring an upward velocity component, this feature also permits the operator a better feel during grinding since the active sector of the disc is better defined.

DETAILED DESCRIPTION

Figure 1:
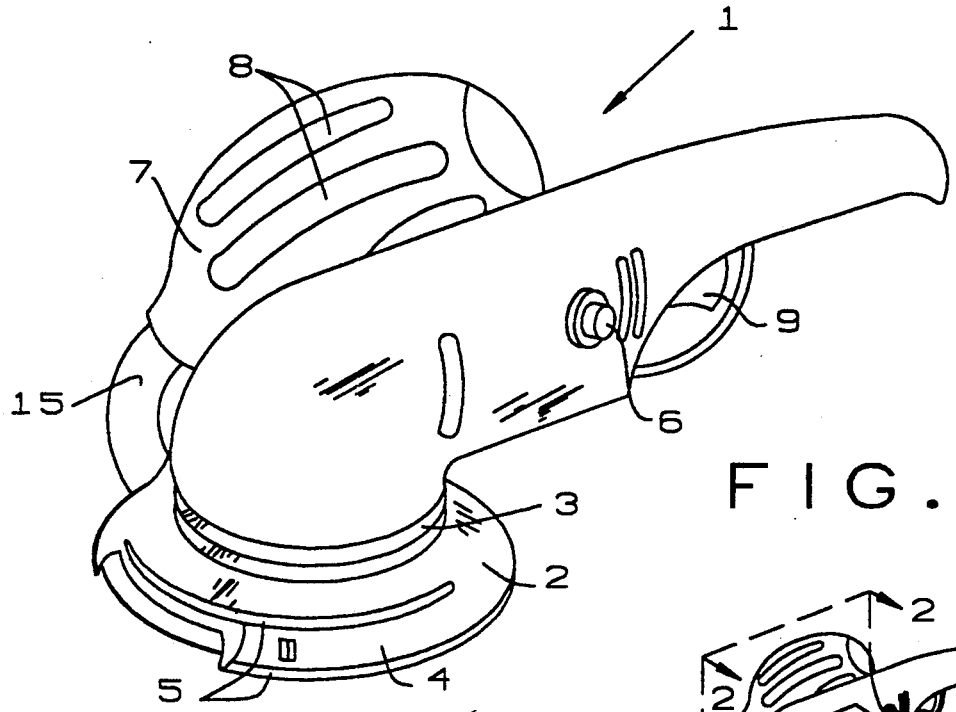
FIG. 1 is a perspective view of the complete surfacing machine.
Figure 1A:
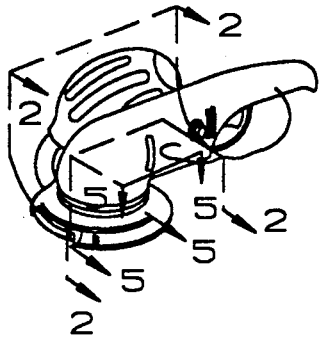

An external overall view of my surfacing machine is shown in FIG. 1 as Item 1. It is electrically powered (cord not shown) and the slots on the sides are for entrance and exit of cooling air for the motor. A trigger Item 9 is shown near the hand grip. In the preferred embodiment, which functions either as a grinder at high speed disc rotation (perhaps 15,000 rpm) or a sander (perhaps 2000 disc rpm). Item 6 is a knob controlling the adjustable speed. The elbow portion of FIG. 1, also shown in FIG. 5, contains speed reduction gearing of fixed ratio in the preferred embodiment. It would be obvious to make the speed reduction from grinder to sander by altering the reduction ratio of a fixed-speed drive motor, but that choice is considered to increase cost and weight and probably to reduce lift.

Figure 4:
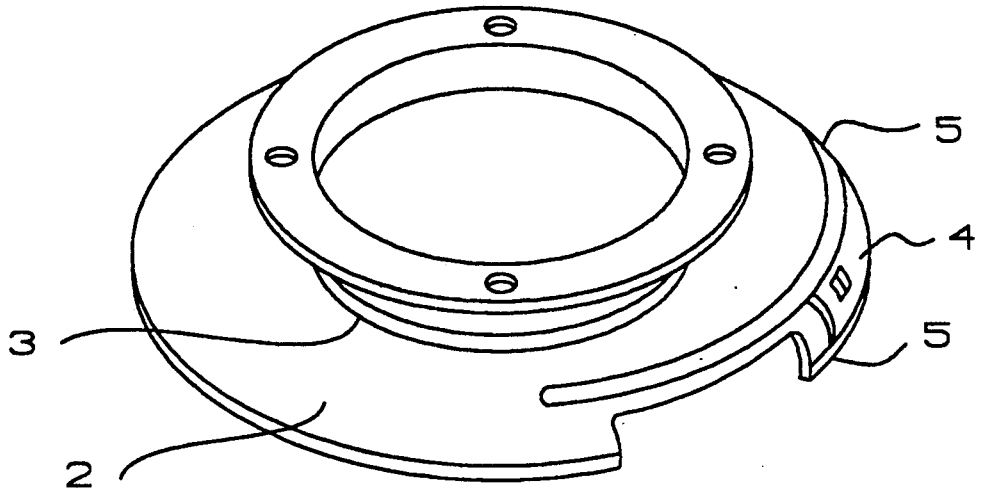
FIG. 4 is a perspective view of the preferred embodiment umbrella structure, using the bellows.
Figure 5:
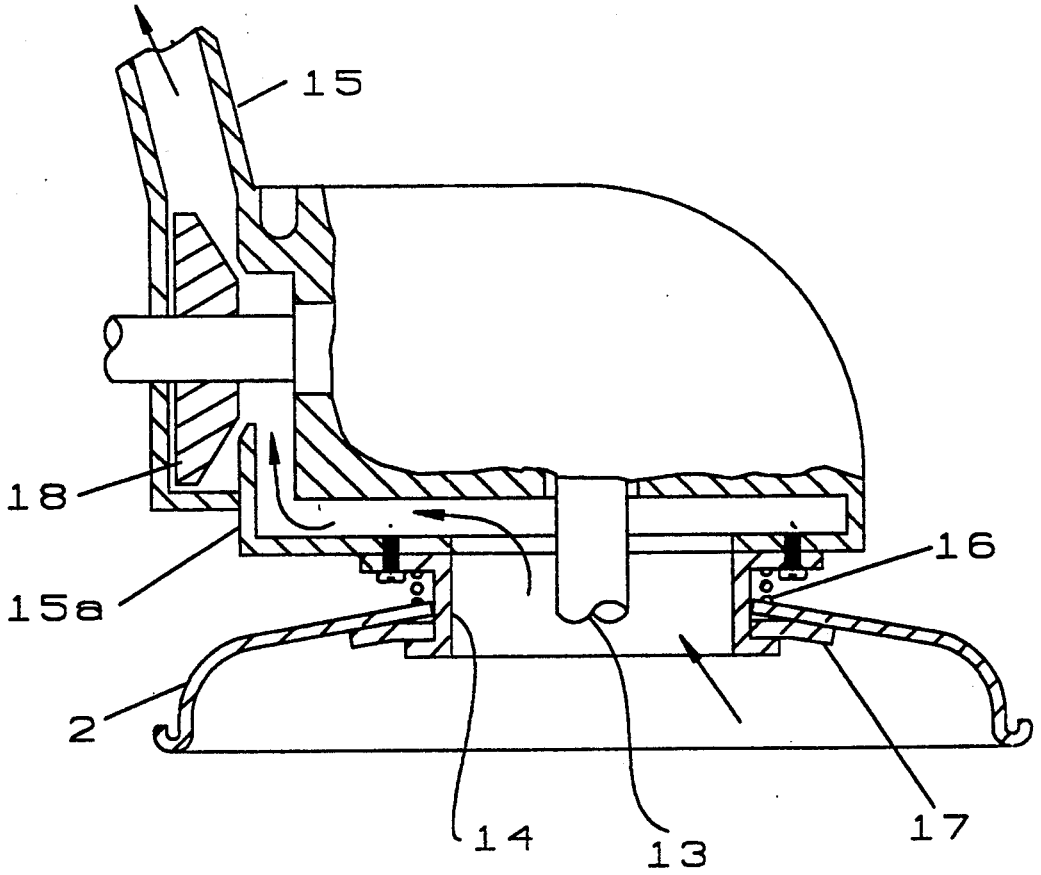
FIG. 5 is another schematic development showing a vertical cross section below the drive motor centerline and a horizontal cross section containing the drive motor centerline. The dust bag is on the side opposite that shown in FIG. 1 in this view. (See explanatory sketch on drawing Sheet 1.)

Other elements of FIG. 1 are the porous debris collector bag Item 8, the bag support member Item 7, and the discharge tube Item 13 running from the suction blower impeller (Item 13 in FIGS. 2 and 5) to the collector bag. In FIG. 5, due to different placement of the suction blower impeller, the dirty air passes through a tube Item 15*a* before entering the suction blower. Item 2 is the umbrella structure, called inflexible in the claims to emphasize that it does not bend in use, but merely moves up and down. Umbrella structure 2 has its lower rim below the grinding disc (Item 12) or abrasive sandpaper disc (Item 11) working surface at rest. Compressing bellows Item 3 or spring Item 16 (FIG. 5) urges umbrella structure 2 to press slightly against the workpiece during use so as to capture almost all the debris generated. Umbrella structure 2 has a slidable portion Item 4 captured by rails Item 5 above and below. When Item 4 is over an opening in Item 2 (shown in FIG. 4) air can only enter the machine below slidable portion Item 4; when Item 4 is slid to uncover the port in umbrella structure 2 (so as to grind or sand up to workpiece protrusions) somewhat more ambient air passes through the system.

Figure 2:
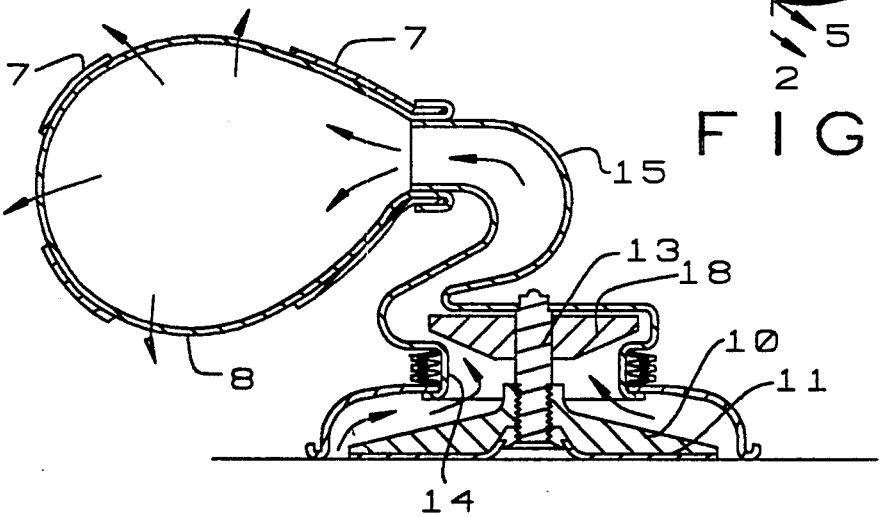
FIG. 2 is a schematic development, basically a cross section except taken as shown in the sketch, partially along the dust bag centerline and partially along the output shaft centerline. (See the explanatory sketch between FIG. 1 and FIG. 2).

FIG. 2 depicts a schematic view of the machine's working parts. Item 11 sanding disc, backed up by rubber cushion Item 10, contacts the workpiece on a working sector and rides above the workpiece in the 180 degree opposite sector. The constant-inside-diameter portion of umbrella structure 2 is high enough to permit this action. Guide sleeve Item 14 (also shown in FIG. 5) fits the upper part of umbrella structure 2 closely but axially slidably so the lower part of umbrella structure 2 remains nearly coaxial with the abrasive disc. FIG. 2 also shows a more conventional volute exit for air leaving impeller 18.

Figure 3:
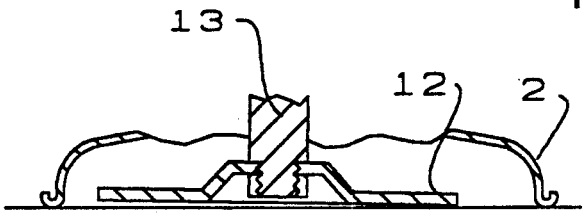
FIG. 3 is a cross section of a grinding disc on a workpiece showing only the rim of the umbrella structure.

FIG. 3 shows a cross sectional view of only the working area using grinding disc 12, and showing the conical working (lower) surface thereof. Debris will be thrown off the part of grinding disc 12 not in contact with the workpiece at a slight upward angle so it contacts the inside surface or umbrella structure 2 rather than the junction it has with the workpiece. The preferred position of slidable portion 4 is directly opposite the user's hand, the same sector of grinding disc 12 which contacts the workpiece. Driven impeller shaft 13, to which either type disc may be assembled using the unmarked nut shown, also appears in FIG. 3.

FIG. 5 shows two alternate embodiments. The suction blower is on the higher-speed drive motor shaft and the porous collector bag is on the opposite side from that shown in FIG. 1. Accordingly duct 15*a* conducts debris-laden air to the suction blower inlet. The other alternative embodiment is the use of spring Item 13 to urge umbrella structure 2 downward, and a new part, elastomeric seal ring 17, which seals any gap between guide sleeve 14 and umbrella structure 2. Elastomeric seal ring 17, in the preferred embodiment, is snugly fitted to guide sleeve 14 and cemented to the interior of umbrella structure 2, but other arrangements to avoid an air leak into the machine at that point are considered within the ability of those skilled in the design art without requiring invention.

Item 7, the bag support member, must not be rigid which would prevent the machine being used to grind or sand up to inside corners. At the same time it must be stiff enough to prevent the annoyance of the bag and support drooping onto the workpiece. Since elastomers are available in a variety of stiffnesses, material of a stiffness to meet both requirements is called herein yielding material.

Also, a conventional bottle, the shape of the dust bag is considered a cylindrical shell reduced in diameter at one end and closed at the opposite end.

The invention having been described in its preferred embodiment it is clear that modifications can be made by those skilled in the art without exercise of the inventive faculty. Accordingly, the scope of this invention is defined by the scope of the following claims.

I claim:

1. A hand-held disc-type surfacing machine having an abrasive disc and a debris collecting system in which a suction blower has an inlet which takes in air containing debris from around the abrasive disc and discharges it inside a porous collector bag, in which the improvement is to the structure for collecting debris abrasively removed from the workpiece, the improvement comprising:

an inflexible umbrella structure having a large lower end of said umbrella structure with a rim area surrounding the abrasive disc and having a small upper end connected to the inlet of the suction blower, and a slideable portion of the rim area of said umbrella structure movable circumferentially to expose the abrasive disc locally, and means for forcing said umbrella structure downwardly against the workpiece to cause the lower rim to contact a flat workpiece through a full circle larger in diameter than the abrasive disc.

2. A device as described in claim 1, in which the means for forcing said umbrella structure is a bellows attached centrally to the small upper end of said umbrella structure.

3. A device as described in claim 1, in which the means for forcing said umbrella structure is a coil spring, and a guide sleeve keeps said umbrella structure centered, and an elastomeric seal ring attached to both said guide sleeve and said umbrella structure preventing air leakage between said umbrella structure and said guide sleeve.

4. A device as described in claim 1, further comprising:

a bag support member of yielding material of a shape similar to an ordinary bottle, said bag support member containing a plurality of openings distributed over its surface other than the neck portion, said bag support member receiving all the debris-laden air from the suction blower through its neck, whereby the surfacing machine debris collector bag may be rendered less susceptible to drooping due to gravity.

5. The machine of claim 1 wherein:

said collector bag is constructed of metal wire mesh.

6. The machine of claim 1 wherein:

said disc is formed to cause debris thereon to be thrown off at a slightly upward angle.

7. A hand-held disc-type surfacing machine having an abrasive disc and a debris collecting system in which a suction blower has an inlet which takes in air containing debris from around the abrasive disc and discharges it inside a porous collector bag, in which the improvement is to the structure for collecting debris abrasively removed from the workpiece, the improvement comprising:

an inflexible umbrella structure having a large lower end of said umbrella structure with a rim area surrounding the abrasive disc and having a small upper end connected to the inlet of the suction blower, and a slideable portion of the rim area of said umbrella structure movable circumferentially to expose the abrasive disc locally, and means for forcing said umbrella structure downwardly against the workpiece to cause the lower rim to contact a flat workpiece through a full circle larger in diameter than the abrasive disc, and a porous collector bag constructed of wire mesh, and a grinding disc having as a working surface contour a circular cone of cone angle of at least 176 degrees rather than a 180 degree flat, whereby debris thrown off the grinding disc will have an upward velocity component.

8. A hand-held surfacing machine comprising:

a motor, a surfacing disc rotatably driven by said motor, a hollow dome-like housing having an annular rim encircling said disc with a portion circumferentially slidable to expose a portion of said disc, a porous collector bag, and a blower communicating with said housing and with said collector bag.

9. The machine of claim 8 wherein:

said collector bag is constructed of metal wire mesh.

10. The machine of claim 8 wherein:

said disc is formed to cause debris thereon to be thrown off at a slightly upward angle.

11. The machine of claim 8 further comprising:

means urging said housing downward to cause said rim to engage a flat workpiece through a full circle about said disc.

12. The machine of claim 8 wherein:

said housing is rigid.

13. The machine of claim 8 wherein:

said surfacing disc has an abrasive surface.

14. The machine of claim 8 wherein:

said surfacing disc engages the workpiece only through a portion of the rotation of said disc.

15. The machine of claim 8 wherein:

said surfacing disc rides above the workpiece during a portion of the rotation of said disc.

16. The machine of claim 8 wherein:

said surfacing disc engages the workpiece surface at an angle of approximately 4°.

* * * * *